US007228573B2

(12) United States Patent
Smith

(10) Patent No.: US 7,228,573 B2
(45) Date of Patent: Jun. 12, 2007

(54) MASSAGING SINK NECK REST

(76) Inventor: Timothy Jon Smith, 18132 Bothell Way NE. Suite B-4, Bothell, WA (US) 98011

( * ) Notice: Subject to any disclaimer, the term of this patent is extended or adjusted under 35 U.S.C. 154(b) by 267 days.

(21) Appl. No.: 11/051,511

(22) Filed: Feb. 4, 2005

(65) Prior Publication Data

US 2005/0172391 A1 Aug. 11, 2005

Related U.S. Application Data

(60) Provisional application No. 60/542,157, filed on Feb. 5, 2004.

(51) Int. Cl.
*A45D 44/10* (2006.01)

(52) U.S. Cl. ..... 4/523; 601/57

(58) Field of Classification Search ..... 4/523; 601/56–57

See application file for complete search history.

(56) References Cited

U.S. PATENT DOCUMENTS

| | | | | |
|---|---|---|---|---|
| 2,261,476 A | 11/1941 | Kiefer | 4/159 |
| 4,327,452 A | 5/1982 | Swatzell | 4/523 |
| 4,669,132 A | 6/1987 | Courson | 4/523 |
| 5,393,297 A | 2/1995 | Kristoff | 601/57 |
| 6,513,176 B1 | 2/2003 | Najar | 4/523 |
| 2002/0115946 A1 * | 8/2002 | Cutler et al. | 601/57 |

* cited by examiner

*Primary Examiner*—Charles E. Phillips
(74) *Attorney, Agent, or Firm*—Dean A. Craine

(57) ABSTRACT

A massaging sink pillow structure disclosed herein designed to be placed over the edge of a standard sink used by a barber or beautician for shampooing or rinsing hair. The sink pillow is a waterproof, saddle-shaped structure with a front section designed to be placed against the front outside surface of the sink and a rear section designed to be placed against the front, inside surface of the sink. The sink pillow includes an upper, U-shaped indented section designed to fit into the U-shaped opening on the sink. Mounted inside the sink pillow is a neck massaging mechanism designed to massage the user's neck in one direction or in alternative directions from front-to-back and back-to-front directions when the user's neck is placed over the U-shaped indented section. Located inside the sink pillow is a printed circuit board, which is connected to a D.C. motor that rotates the eccentric element against the elongated member.

5 Claims, 4 Drawing Sheets

MASSAGING SINK NECK REST

This utility patent application is based on the provisional patent application (Ser. No. 60/542,157) filed on Feb. 5, 2004.

BACKGROUND OF THE INVENTION

1. Field of the Invention

The present invention relates to neck rests, and more particularly to neck rests used with sinks that support the neck in a reclined position as the head is placed in the sink for hair treatment, shampooing, or rinsing.

2. Description of the Related Art

When a person's head is tilted rearward into a sink for shampooing or rinsing, the neck is arched rearward and supported by the sides of the sink. Because the hair is soaked with shampoo and water and scrubbed, considerable stress is placed on the back of the neck. If the neck is held in the position too long, the person's neck muscles may become fatigued and blood flow through the neck may be impeded. In some instances, this can cause light-headedness or dizziness.

Vibrating neck rests that support a user's neck over the edge of a sink when shampooing the user's hair is known in the prior art. For example, U.S. Pat. No. 5,393,297 discloses a neck pillow with an internal vibrating mechanism designed to massage the neck muscles when the user's neck is placed on the sink. The vibrating mechanism is made up of a plurality of balls aligned in rows that extend transversely over the pillow's neck supporting surface. The balls in each row are mounted on a transversely aligned rod. The center ball in each row is also mounted on a longitudinally aligned rotating center rod that includes an eccentric. When the center rod is rotated, the eccentric also rotates which causes the center ball to move upward, downward and laterally. The adjacent balls located on the same row wiggle back and forth thereby vibrating the user's neck.

It is this inventor's belief that the vibrational mechanism used in the prior art does not adequately massage the back of the user's neck for several reasons. First, the vibrating action of the mechanisms, do not deeply penetrate the neck. Second, such mechanisms do not promote blood flow in the neck when the head is held in a reclined position over a sink.

SUMMARY OF THE INVENTION

It is an object of the present invention to provide a sink pillow for supporting the neck when the head is held in a reclined position over a sink when shampooing, rinsing or applying a hair treatment to a user's hair.

It is another object of the present invention to provide a sink pillow that deeply massages the muscles in the neck.

It is a further object of the present invention to provide a sink pillow that promotes blood flow in the neck while the neck is supported on the edge of the sink.

These and other objects of the invention are met by the massaging sink pillow disclosed herein designed to be placed over the edge of a standard sink used by a barber or beautician for shampooing or rinsing a customer's hair. Such sinks are typically deep basins with tall sidewalls and a U-shaped opening formed on the front sidewall designed to receive the consumer's neck when the head is reclined rearward into the basin. The sink pillow is a saddle-shaped structure with a front section designed to be placed against the outside surface of the front wall of the sink and a rear section designed to be placed against the inside surface of the front wall of the sink. The sink pillow includes an upper, U-shaped indented section located between the front and rear sections designed to fit into the U-shaped opening formed on the sink.

Mounted inside the sink pillow is a neck massaging mechanism designed to massage the posterior surface of the consumer's neck in one direction or in alternating directions, such as front-to-back and back-to-front directions when the consumer's neck is placed over the U-shaped indented section. The neck massaging mechanism includes an elongated pad mounted longitudinally inside the sink pillow. The elongated pad is mounted just below the lower apex of the U-shaped indented section so that it presses and massages the nape of the neck when the neck is placed over the U-shaped indented section. Located below the elongated pad is an eccentric element that rotates and causes the elongated pad to gently lift and roll in a clockwise or counter-clockwise direction. The lift and rolling action applies an upward or downward force to the nape of the neck, which promotes blood flow in the neck.

Located inside the sink pillow is a printed circuit board (hereinafter referred to as a PCB), which is connected to a D.C. motor that rotates the eccentric element against the elongated member. The PCB is connected to two or more standard or re-chargeable AAA or AA batteries also mounted inside the sink pillow and to the control switch mounted on the sides of the sink pillow. The control switch may be a variable speed control/intensity switch that allows the barber or beautician to control the rate and intensity of the movement of the eccentric member. The device may also include an optional, built-in remote control receiver that communicates with a handheld remote control transmitter that may be operated by the user, barber or beautician. An optional re-charging D.C. female in-plug and battery discharge/charging indicator light may be mounted on the surface of the sink pillow to inform the barber or beautician of the amount of electrical charge in the batteries. In the preferred embodiment the main on/off control switch, variable speed switch, battery discharge meter and the D.C. power plug are all mounted on a control panel located on the lower edge of the pillow's front sidewall.

In the preferred embodiment, the sink pillow includes an inside layer made of waterproof material and an outside layer made of sufficiently durable, attractive material, such as leather or vinyl.

DESCRIPTION OF THE PREFERRED EMBODIMENT(S)

Figure 1:
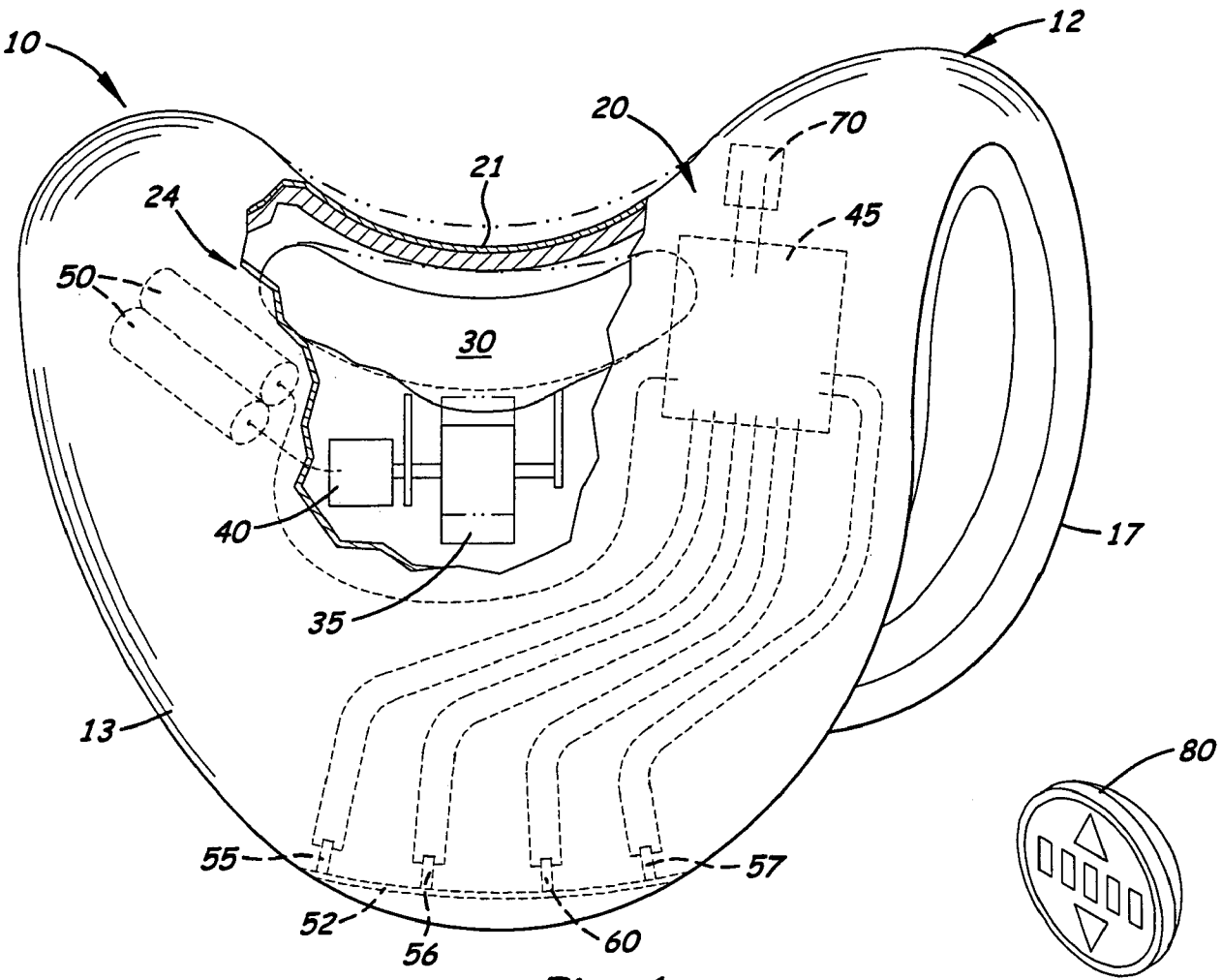
FIG. 1 is a perspective view of the massaging sink pillow disclosed herein.
Figure 2:
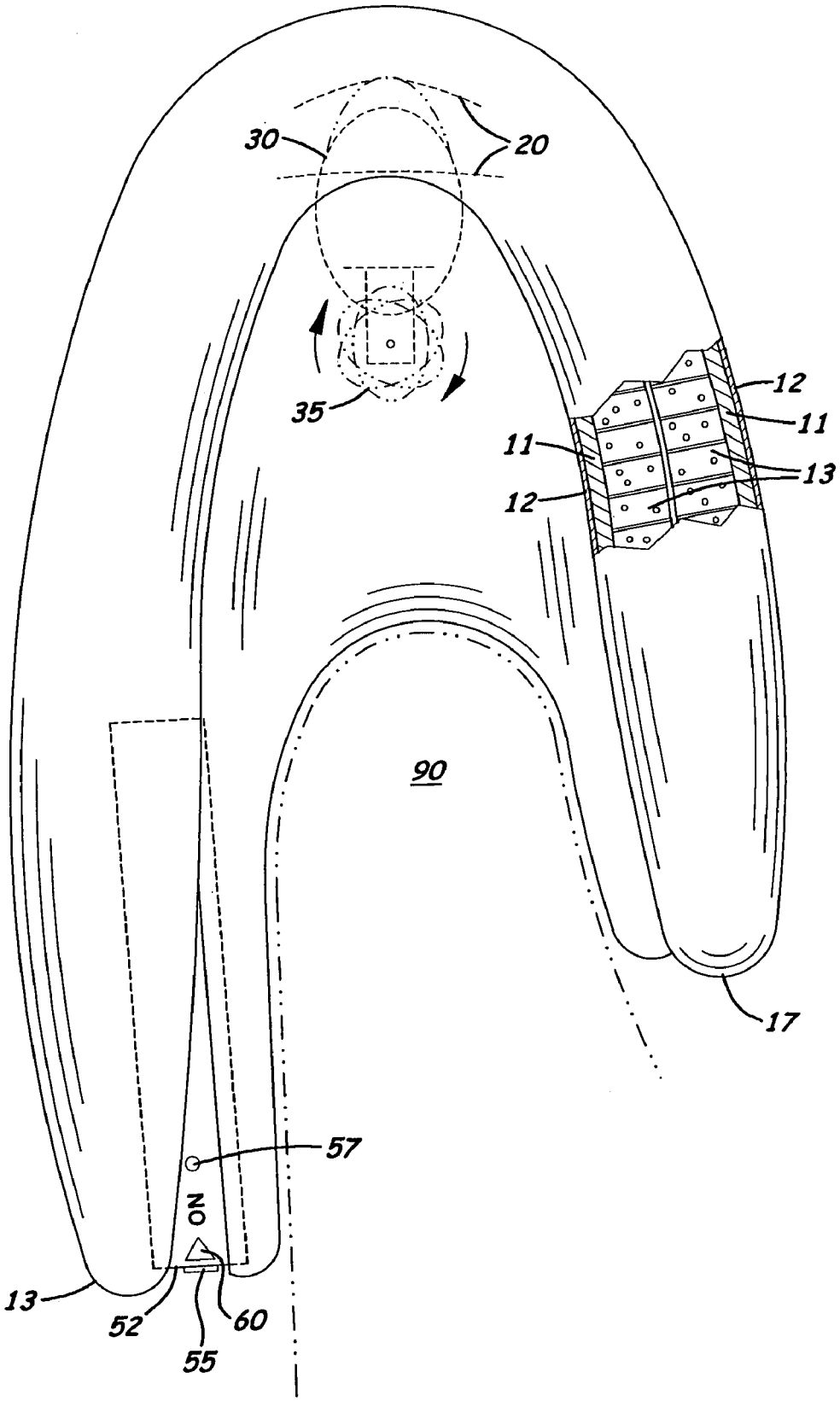
FIG. 2 is a side elevation view of the invention.
Figure 3:
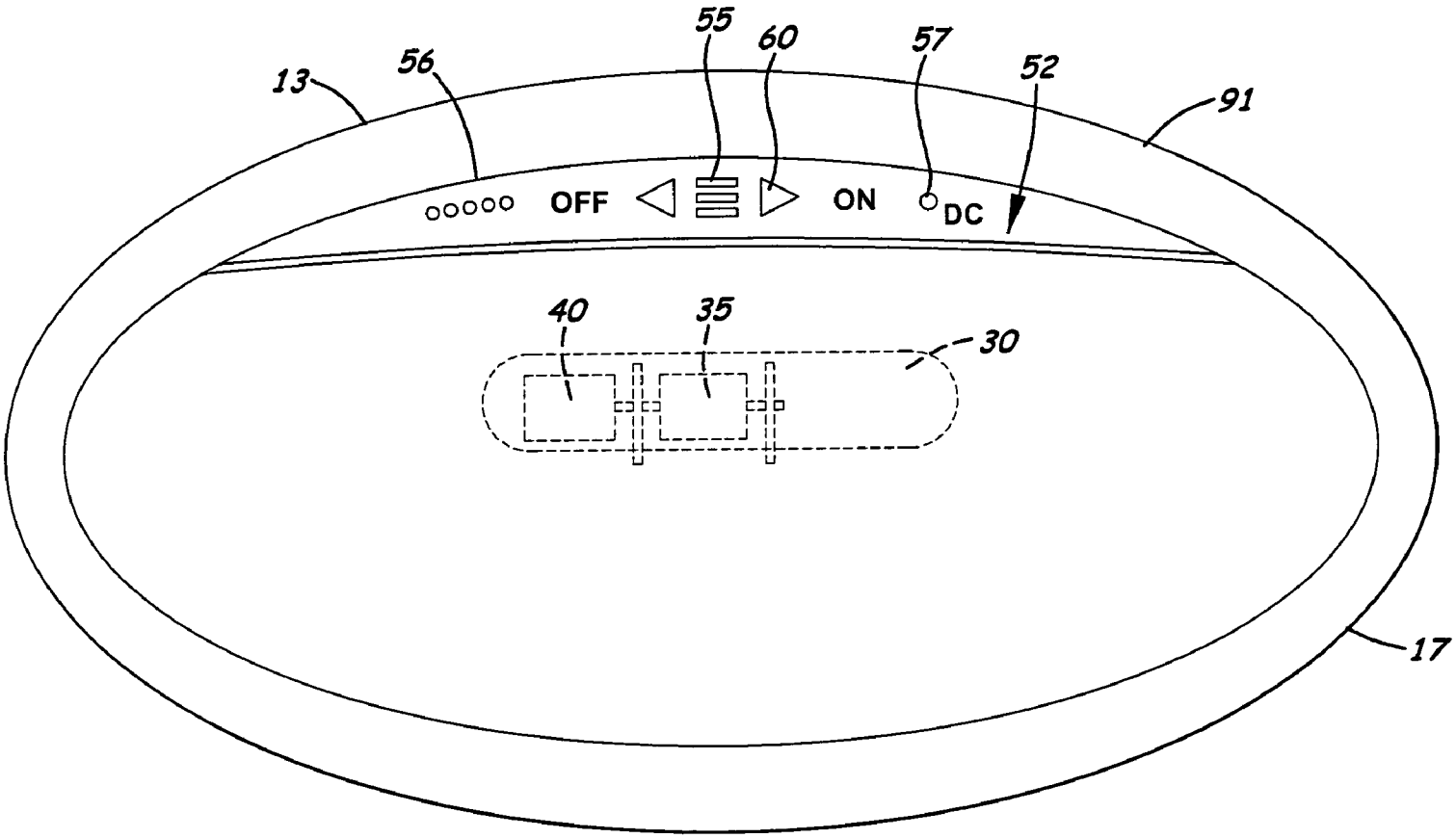
FIG. 3 is a top plan view of the invention.
Figure 5:
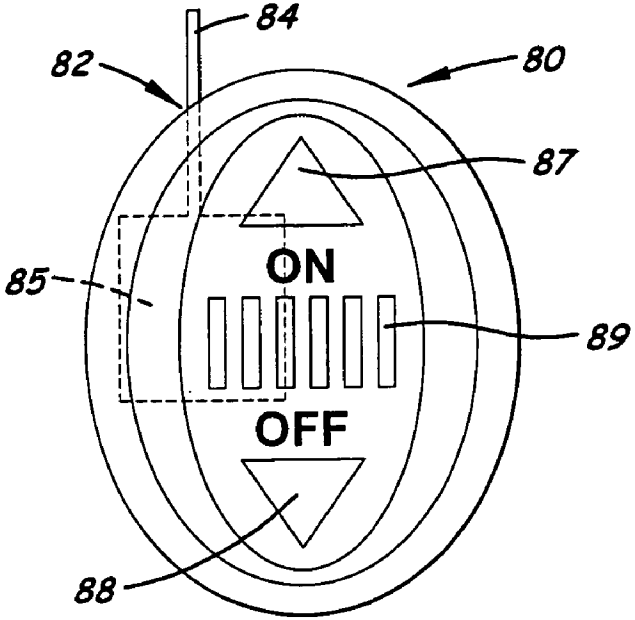
FIG. 5. is a front plan view of the remote control transmitter.
Figure 4:
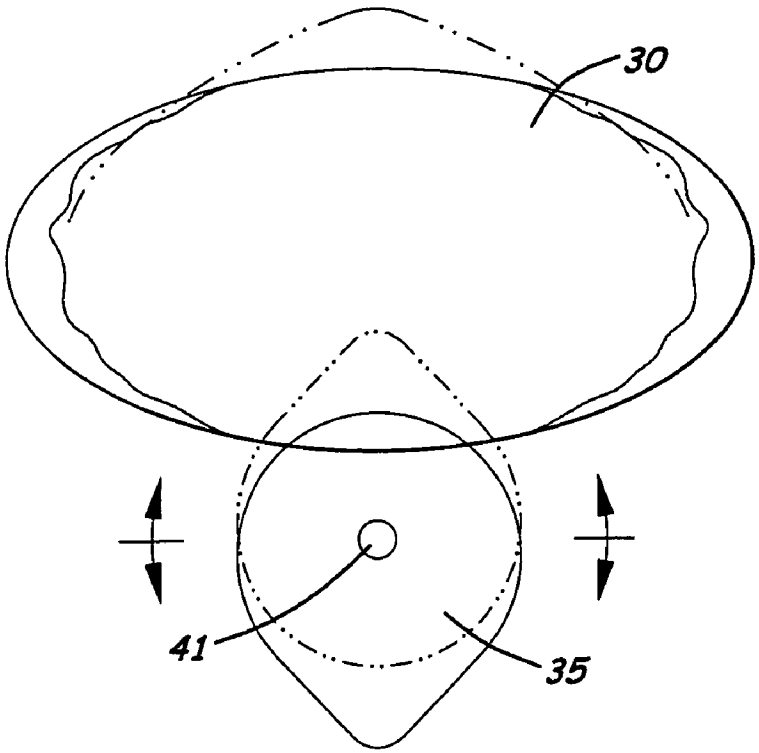
FIG. 4 is a front elevational view of the elongated pad and the eccentric member showing the movement of the elongated pad.

These and other objects of the invention are met by the massaging sink pillow 10 disclosed herein which is designed to be placed over the edge of a standard sink 90 used by a barber or beautician for shampooing or rinsing hair. Such a sink 90 is a deep basin with tall sidewalls 91 and a U-shaped opening 92 formed on the front sidewall 91 designed to receive the user's neck when the head is reclined rearward and into the sink 90. The sink pillow 10 is a saddle-shaped structure with a front section designed to be placed against the outside surface of the front sidewall 91 and a rear section 17 designed to be placed against the front, inside surface of the front sidewall 91. The sink pillow 10 includes an upper, U-shaped indented section 20 designed to fit into the U-shaped opening 92 on the sink 90.

Mounted inside the sink pillow 10 is a neck massaging mechanism 24 designed to massage the user's neck in one direction or in alternating directions from front-to-back and back-to-front directions when the user's neck is placed over the U-shaped indented section 20. The neck massaging mechanism 24 includes an elongated pad 30 longitudinally aligned and mounted inside the sink pillow 10. The elongated pad 30 is mounted just below the lower apex 21 of the U-shaped indented section 20 so that it messages the nape of the neck when the neck is placed on the U-shaped indented section 20. Located below the elongated pad 30 is a rotating eccentric element 35 that rotates around a central axis 41 and causes the elongated pad 30 to lift and roll clockwise or counter-clockwise directions. The lift and rolling action applies an upward or downward force on the nape of the neck that promotes blood flow there though.

Located inside the sink pillow 10 is a printed circuit board 45 (hereinafter referred to as a PCB) that is connected to a D.C. motor 40 that rotates the eccentric element 35 against the elongated member 30. The PCB 45 is connected to two or more standard or re-chargeable AAA or AA batteries 50 also mounted inside the sink pillow 10 and to an on/off control switch 55 mounted on the side of the sink pillow 10. The control switch 55 may be a variable speed control/intensity feature that allows the user to control the rate of movement of the eccentric member 30. The sink pillow 10 may also include an optional, built-in remote control receiver 70 that communicates with a handheld remote control transmitter 80 that may be operated by the user, barber or beautician. An optional re-charging D.C. female in-plug 57 and battery discharge/charging indicator light 56 may be provided to assist the user in recharging the batteries 50. In the preferred embodiment, the main on/off control switch 55, the battery discharge/charging indicating light 56 and the D.C. power plug 57 are all mounted on a panel 52 located on the lower edge of the front sidewall 91.

In the preferred embodiment, the sink pillow 10 includes an inside layer 11 made of waterproof material and an outside layer 12 made of sufficiently durable, attractive material, such as leather or vinyl. An optional foam layer 13 may be provided to provide greater comfort.

The remote control transmitter 80 includes a body 82 with an increase and decrease intensity control switch 87, 88 respectively, and a visual indicator 89. Mounted inside the transmitter 80 is a PCB 85 with an antenna 84 attached thereto.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A massaging sink pillow structure, comprising;

a. a water-proof, saddle-shaped structure with a front section designed to be placed against the front outside surface of the sink and a rear section designed to be placed against the front, inside surface of the sink, said sink pillow includes an upper, U-shaped indented section designed to fit into a U-shaped opening on the sink, said saddle-shaped structure includes a face panel located on a lower edge of said front section;

b. a neck massaging mechanism located inside said saddle shaped structure, said neck massaging mechanism includes an elongated pad member located in said U-shaped indented section, an eccentric member, and a motor coupled to said eccentric member, said eccentric member capable of applying a lifting force against said elongated pad member which results in an upward force being applied to a user's neck positioned in said U-shaped opening, and;

c. a main control switch mounted on said face panel.

2. The massaging sink pillow, as recited in claim 1, provided a D.C. electrical power source in the form of a battery.

3. The massaging sink pillow, as recited in claim 2, wherein said battery is re-chargeable.

4. The massaging sink pillow, as recited in claim 3, further including a charge indicator light used to indicate the amount of charge remaining in said battery.

5. The massaging sink pillow, as recited in claim 1, where said D.C. electrical power source is an A.C. to D.C. transformer.

* * * * *